US008465379B2

(12) United States Patent
Wada et al.

(10) Patent No.: US 8,465,379 B2
(45) Date of Patent: Jun. 18, 2013

(54) GOLF CLUB HEAD

(75) Inventors: Kozue Wada, Chichibu (JP); Hideo Matsunaga, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 207 days.

(21) Appl. No.: 13/026,781

(22) Filed: Feb. 14, 2011

(65) Prior Publication Data

US 2011/0201451 A1 Aug. 18, 2011

(30) Foreign Application Priority Data

Feb. 15, 2010 (JP) ..... 2010-029998

(51) Int. Cl.
*A63B 53/04* (2006.01)

(52) U.S. Cl.
USPC ..... 473/329; 473/342; 473/346

(58) Field of Classification Search
USPC ..... 473/324–350, 287–292
See application file for complete search history.

(56) References Cited

U.S. PATENT DOCUMENTS

| | | | | |
|---|---|---|---|---|
| 2,087,685 | A * | 7/1937 | Hackney | 473/349 |
| 3,814,437 | A * | 6/1974 | Winquist | 473/350 |
| 5,377,985 | A * | 1/1995 | Ohnishi | 473/324 |
| 5,547,427 | A * | 8/1996 | Rigal et al. | 473/345 |
| 5,669,829 | A * | 9/1997 | Lin | 473/346 |
| 5,830,084 | A * | 11/1998 | Kosmatka | 473/349 |
| 6,840,872 | B2 * | 1/2005 | Yoneyama | 473/346 |
| 6,899,638 | B2 * | 5/2005 | Iwata et al. | 473/329 |
| 6,926,618 | B2 * | 8/2005 | Sanchez et al. | 473/329 |
| 7,220,190 | B2 * | 5/2007 | Hirano | 473/342 |
| 7,258,626 | B2 * | 8/2007 | Gibbs et al. | 473/329 |
| 7,387,579 | B2 * | 6/2008 | Lin et al. | 473/332 |
| 7,442,132 | B2 * | 10/2008 | Nishio | 473/342 |
| 7,494,426 | B2 * | 2/2009 | Nishio et al. | 473/350 |
| 7,578,755 | B2 * | 8/2009 | Oyama | 473/342 |
| 7,614,964 | B2 * | 11/2009 | Matsunaga | 473/342 |
| 7,618,331 | B2 * | 11/2009 | Hirano | 473/329 |
| 7,993,214 | B2 * | 8/2011 | Hirano | 473/329 |
| 8,012,041 | B2 * | 9/2011 | Gibbs et al. | 473/329 |
| 8,070,623 | B2 * | 12/2011 | Stites et al. | 473/329 |
| 8,226,498 | B2 * | 7/2012 | Stites et al. | 473/329 |
| 2010/0105501 | A1 * | 4/2010 | Wada et al. | 473/346 |
| 2012/0064994 | A1 * | 3/2012 | Wada et al. | 473/346 |

FOREIGN PATENT DOCUMENTS

| | | | |
|---|---|---|---|
| JP | 09239075 | A | 9/1997 |
| JP | 2002035178 | A | 2/2002 |
| JP | 2006-141806 | A | 6/2006 |
| JP | 2006230772 | A | 9/2006 |
| JP | 2008-036050 | A | 2/2008 |

* cited by examiner

*Primary Examiner* — Sebastiano Passaniti
(74) *Attorney, Agent, or Firm* — Sughrue Mion, PLLC

(57) ABSTRACT

A face portion of a golf club head includes first to fourth main ribs on an inner surface of the head. The first main rib extends from a center portion of the face portion toward a crown, and the second main rib extends from the center portion toward a sole. The face portion is formed to have such a thickness that the center portion, the first main rib, and the second main rib become thinner in this order. The third and fourth main ribs extend from the center portion in outward directions of the face portion.

20 Claims, 3 Drawing Sheets

GOLF CLUB HEAD

CROSS-REFERENCE TO RELATED APPLICATION

This application claims priority from Japanese Patent Application No. 2010-029998 filed Feb. 15, 2010, which is incorporated herein by reference in its entirety.

BACKGROUND OF THE INVENTION

The present invention relates to a golf club head, and specifically relates to a golf club head having an improvement in the thickness of a back surface of a face portion.

Most recent wood clubs have heads, at least the face portions, made of a metal material. A face portion needs to have a sufficiently large thickness to have strength sufficient to withstand impact with a ball. Although the size of heads has been increasing, the size must be less than a volume of 460 $cm^3$ with a tolerance of +10 $cm^3$ by rule. Thus, most drivers now have 460-$cm^3$ large heads extremely close to the upper limit.

Such increase in head size accordingly increases the weight of a face portion. To reduce the weight of a face portion and to retain the strength of the face portion also, the thickness of the face portion is reduced while a rib is provided to a back surface of the face portion. For example, Japanese Patent Application Publication No. 2006-141806 describes a face portion in which six ribs extend from a central portion of the face to circumferential portions of the face.

Meanwhile, if ribs are provided in an X-shaped arrangement on a central portion of a back surface of a face portion, the face portion provides a considerably lower restitution performance when a ball is hit at a sole side or crown side of the face than when at the center of the face. To solve this problem, Japanese Patent Application Publication No. 2008-36050 describes a face portion whose back surface is divided into four segments by such ribs in such a manner that the thicknesses of sole-side and crown-side segments are smaller than those of toe-side and heel-side segments.

Conventionally, a number of high-restitution heads with a remarkably increased coefficient of restitution (hereinafter, COR), have been developed. However, high-restitution heads having a COR of 0.830 or higher cannot be used in competitions after 2008. For this reason, a golf club head having a COR that is not increased at the center of a face portion is currently under development. It has been found, however, that if the COR at the center of a face portion is not increased, the restitution performance at a surface of the face other than the center is reduced; in particular, the performance at a sole side of the face is reduced more than that of a crown side thereof.

SUMMARY OF THE INVENTION

In view of the above-described problems, an object of the present invention is to provide a golf club head that includes a face portion having a reduced weight while retaining the strength and having a low restitution performance at a level that conforms to a COR rule, and that is capable of demonstrating a substantially uniform restitution performance, even when a ball is hit off the center of the face.

In order to achieve the above object, a golf club head according to the present invention has a hollow structure, and includes: a face portion having a ball hitting surface; and at least four main ribs disposed on an inner surface of the face portion. In the golf club head, among the four main ribs, a first main rib extends from a center portion of the face portion toward a crown, a second main rib extends from the center portion toward a sole, and the other two main ribs also extend from the center portion toward the outside of the face portion, and the face portion is formed to have such a thickness that the center portion, the first main rib, and the second main rib become thinner in this order.

It is preferable that, among the four main ribs, a third main rib extend from the center portion toward a hosel, a fourth main rib extend from the center portion toward a portion, closer to a toe, of the sole, and the face portion be formed to have such a thickness that the center portion, the third main rib, and the fourth main rib become thinner, in this order.

It is preferable that the face portion be divided by the first to fourth main ribs into four regions: a region on a toe and crown side of the face portion; a region on a toe and sole side thereof; a region on a heel and crown side thereof; and a region on a heel and sole side thereof, and the face portion in the region on the toe and sole side be formed to have a thickness smaller than a thickness in the region on the heel and crown side.

The golf club head according to the present invention preferably includes, at the center portion where the first to fourth main ribs intersect, a center of gravity of the golf club head, which is projected on the surface of the face portion. Furthermore, the golf club head according to the present invention preferably further includes a reinforcement rib disposed on the inner surface of the face portion and extending toward the outside of the face portion from the center portion where the first to fourth main ribs intersect. Furthermore, it is preferable that the reinforcement rib have a thickness gradually reduced from the intersecting portion in the outward direction, and be formed to extend to a position between the center portion and an end portion of the face portion.

In the present invention as described above, at least four main ribs are provided, including the first main rib extending from the center portion toward the crown and the second main rib extending from the center portion toward the sole. Additionally, the face portion is formed to have such a thickness that the center portion, the first main rib, and the second main rib become thinner, in this order. Accordingly, the face portion has a reduced weight while retaining the strength, and the restitution performance of the face portion is reduced to such a level that conforms to a COR rule; furthermore, even when a ball is hit off the center of the face, a substantially uniform restitution performance can be demonstrated.

DETAILED DESCRIPTION OF THE PREFERRED EMBODIMENT

Hereinafter, a golf club head of an embodiment according to the present invention will be described with reference to the attached drawings.

Figure 1:
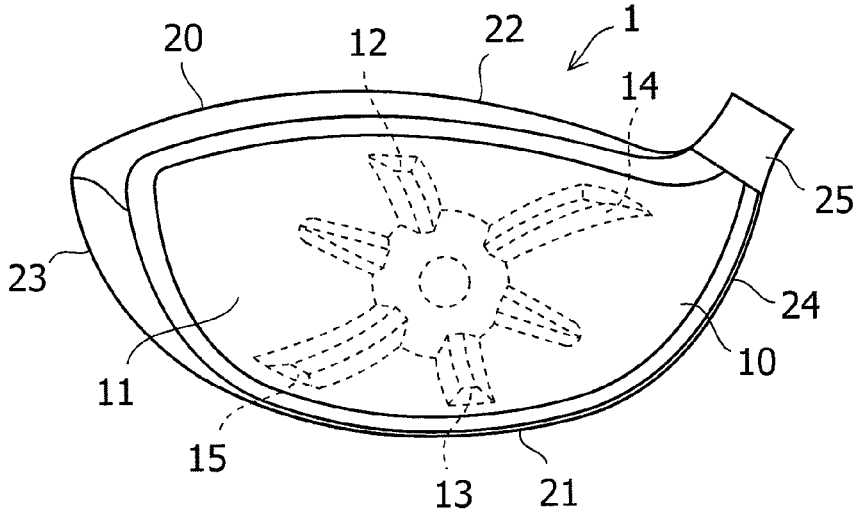
FIG. 1 is a front view showing a golf club head according to an embodiment of the present invention.

As shown in FIG. 1, a golf club head 1 mainly includes: a face member 10 having a face portion 11; and a main body member 20. The main body member 20 includes a sole portion 21, a crown portion 22, a side portion extending from a toe 23 to a heel 24 through a back face (not illustrated), and a hosel portion 25, which are integrally formed. The face member 10 and the main body member 20 are bonded together by welding. Thereby, the head has a hollow structure.

In FIG. 1, the broken lines illustrate a configuration present on a surface, on the hollow-structure side, of the face member 10, that is, on a back surface of the face member 10. On the back surface of the face member 10, ribs and an intersecting portion 17 thereof are formed, which are thickened portions of the face member 10. The back surface of the face member 10 will be described.

As shown in FIG. 2*a*, a first main rib 12, a second main rib 13, a third main rib 14, and a fourth main rib 15 are formed on a substantially flat surface, on the back side, of the face member 10. The first main rib 12 extends from a center portion of the face portion 11 toward the crown, specifically toward the center of a boundary between the face portion and the crown portion. The second main rib 13 extends from the center portion toward the sole, specifically toward the center of a boundary between the face portion and the sole portion. The third main rib 14 extends from the center portion toward the hosel. The fourth main rib 15 extends from the center portion toward a portion, closer to the toe, of the sole, that is, toward a portion, closer to the toe, of a boundary between the face portion and the sole portion. The first to fourth main ribs 12 to 15 are connected to one another through the intersecting portion 17 which is disposed in the central portion of the face portion 11, and which has a substantially flat circular shape. The first to fourth main ribs 12 to 15 extending from the intersecting portion 17 located at the center portion of the face portion 11 as described above are capable of reducing the restitution performance at the center portion of the face portion 11.

The first to fourth main ribs 12 to 15 are preferably formed to extend to end portions of the face portion 11 or to the vicinity of the end portions. The intersecting portion 17 of the face portion 11 is surrounded by a substantially flat peripheral portion 19. The peripheral portion 19 is divided by the first to fourth main ribs 12 to 15 into four regions: a toe-crown region 19*a*, a toe-sole region 19*b*, a heel-crown region 19*c*, and a heel-sole region 19*d*.

Figure 3:
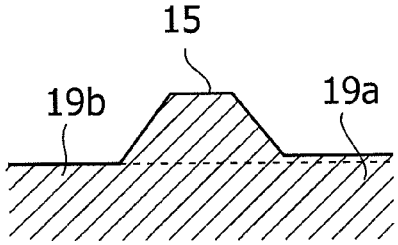
FIG. 3 is a schematic cross-sectional view showing the face member in FIG. 2, taken along the line III-III.
Figure 4:
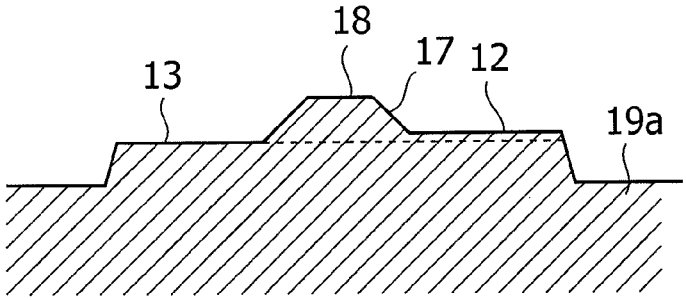
FIG. 4 is a schematic cross-sectional view showing the face member in FIG. 2, taken along the line IV-IV.

All of the first to fourth main ribs 12 to 15 are each formed to have a thickness which is largest at its center and is reduced toward the adjacent substantially flat peripheral portions. For instance, as shown in FIG. 3, the thickness of the main rib 15 is largest at its center, and is reduced toward the toe-crown region 19*a* and toward the toe-sole region 19*b*. In addition, all of the first to fourth main ribs 12 to 15 are respectively formed to have constant thicknesses from the intersecting portion 17 toward outer edge of the face portion 11. For instance, as shown in FIG. 4, the main ribs 12 and 13 are respectively formed to have constant thicknesses from the intersecting portion 17 toward the outer edge of the face portion 11. Note that the cross-sectional views of FIGS. 3 and 4 are intended to facilitate understanding of the configuration of this embodiment, and are not drawn according to exact scale.

Moreover, a thickest portion of at least one of the first to fourth main ribs 12 to 15 is formed to differ in thickness from corresponding portions of the other main ribs. For example, as shown in FIG. 4, the thickness of the first main rib 12 is preferably formed larger than the thickness of the second main rib 13. Meanwhile, the thickness of the third main rib 14 is preferably formed larger than the thickness of the fourth main rib 15. In this manner, the thicknesses of the main ribs located at a crown side of the center portion of the face portion 11 are formed larger than the thicknesses of the main ribs located at a sole side thereof. Thereby, the restitution performance of the entire face portion 11 can be made substantially uniform. The thicknesses of the first main rib 12 and the third main rib 14 located on the crown side may be the same or different from each other. In addition, the thicknesses of the second main rib 13 and the fourth main rib 15 located on the sole side may be the same or different from each other.

The thicknesses of the thickest portions of the main ribs on the crown side and those on the sole side differ from each other by preferably approximately 0.2 mm or larger, more preferably approximately 0.3 mm or larger. Meanwhile, the upper limit of this difference in thickness is preferably approximately 0.7 mm or less, more preferably approximately 0.6 mm or less. Moreover, the thickness of a thickest portion of a thinnest main rib among the first to fourth main ribs 12 to 15 needs to differ from the thickness of the adjacent peripheral portion 19 by at least approximately 0.3 mm or more, preferably approximately 0.5 mm or more, more preferably approximately 0.6 mm or more. Meanwhile, the upper limit of this difference in thickness is preferably approximately 2.0 mm or less, more preferably approximately 1.8 mm or less.

The first to fourth main ribs 12 to 15 are preferably formed to have a substantially equal width. The widths of the first to fourth main ribs 12 to 15 at portions in contact with the back surface of the face portion are preferably approximately 2 mm or more, more preferably approximately 3 mm or more. Meanwhile, the upper limit of the widths of the first to fourth main ribs 12 to 15 are preferably approximately 12 mm or less, more preferably approximately 10 mm or less.

Figure 2:
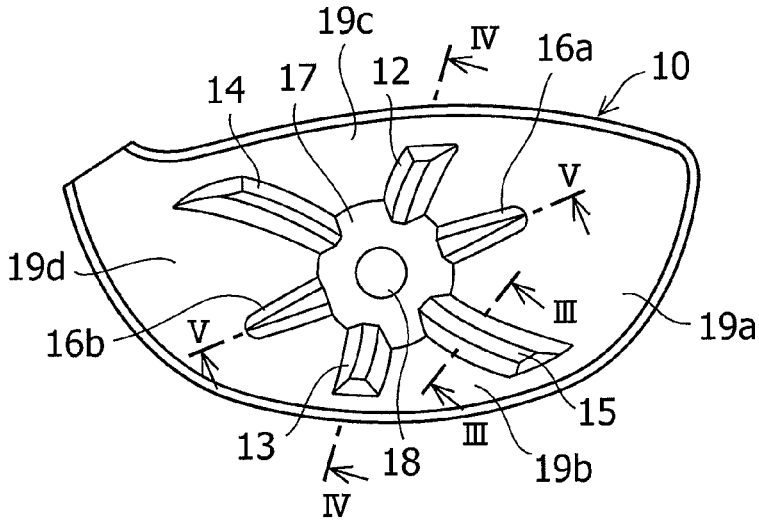
FIG. 2 is back view of a face member of the golf club head shown in FIG. 1.

On the back surface of the face portion 11, a reinforcement rib may be formed. As the reinforcement rib, a toe-side reinforcement rib 16*a* extending from the intersecting portion 17 to the toe-crown region 19*a* and a heel-side reinforcement rib 16*b* extending from the intersecting portion 17 to the heel-sole region 19*d* are formed as shown in FIG. 2. These toe- and heel-side reinforcement ribs 16*a*, 16*b* each have a linear shape, and are disposed with the intersecting portion 17 in between. The reinforcement ribs 16 are formed when, for example, the restitution performances at regions of the peripheral portion 19 such as the toe-crown region 19*a* and the heel-sole region 19*d* are high and exceed the range of the COR rule, thus leading to reduction in the restitution performances at such regions.

Figure 5:
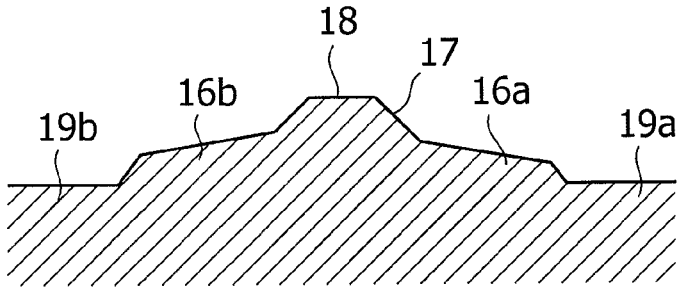
FIG. 5 is a schematic cross-sectional view showing the face member in FIG. 2, taken along the line V-V.

Each reinforcement rib 16 is also formed to have a thickness which is largest at its center and is reduced toward the peripheral portion, as in the case of the main ribs. Meanwhile, the reinforcement rib 16 is formed to have the thickness gradually reduced from the intersecting portion 17 toward the outer edge of the face portion 11 as shown in FIG. 5. Note that the cross-sectional view of FIG. 5 is intended to facilitate understanding of the configuration of this embodiment, and is not drawn according to exact scale. The reinforcement rib 16 is also formed to have a width that becomes gradually narrower from the intersecting portion 17 toward the outer edge of the face portion 11. The reinforcement rib 16 formed thinner and narrower from the center toward the outer edge in this manner is capable of suppressing abrupt change in rigidity. A leading edge of the reinforcement rib 16 can be formed in an arc shape. The radius of this circle is preferably 10 mm or larger, more preferably 15 mm or larger, for example.

The reinforcement rib 16 can be formed from the center portion of the face portion to a position between the central portion and the outer edge. The length of the reinforcement rib 16 is preferably approximately 45% or more, more preferably approximately 50% or more, of the length from the center portion to the outer edge of the face portion 11. Meanwhile, the upper limit of the length of the reinforcement rib 16 is preferably approximately 90% or less, more preferably approximately 85% or less of the above length. The length of the reinforcement rib 16 on the toe side and that of the reinforcement rib 16 on the heel side may be the same or different from each other.

A thickest portion of the reinforcement rib 16 may be as thick as, thicker, or thinner than the thickest portion of a thickest main rib among the first to fourth main ribs 12 to 15. When the thickest portion of the reinforcement rib 16 is thinner or thicker, the difference between the two is preferably approximately 0.1 mm or more but approximately 0.5 mm or less. The width of the thickest portion of the reinforcement rib 16 is preferably approximately 2 mm or more, more preferably approximately 3 mm or more. Meanwhile, the upper limit of the width of the reinforcement rib 16 is preferably approximately 12 mm or less, more preferably approximately 10 mm or less.

Figure 6:
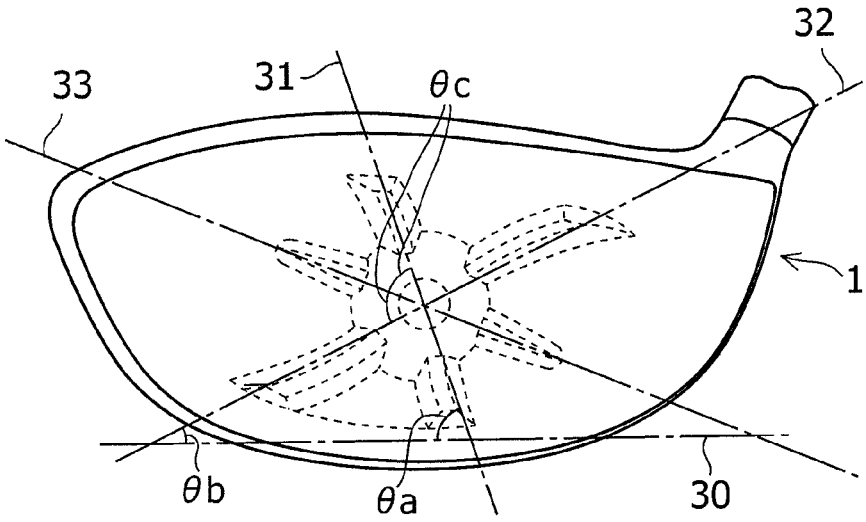
FIG. 6 is a front view showing angles of ribs on the face member in FIG. 1.

The first main rib 12 preferably inclines toward the toe with respect to the vertical direction. The second main rib 13 preferably inclines toward the heel with respect to the vertical direction. The first and second main ribs 12, 13 inclined in this manner allow the restitution performance to be demonstrated to the maximum in an upper portion of the toe and a lower portion of the heel at which amateur golfers are most likely to hit balls. Specifically, as shown in FIG. 6, when the golf club head 1 is positioned at a normal address position, an inclination θa of a central line 31 of the first and second main ribs 12, 13 with respect to a horizontal line 30 is preferably approximately 90° or lower, more preferably approximately 85° or lower. Meanwhile, the lower limit of the inclination θa is preferably approximately 25° or higher, more preferably approximately 30° or higher.

The third main rib 14 preferably inclines toward the crown or hosel with respect to the horizontal direction. The fourth main rib 15 preferably inclines toward the sole with respect to the horizontal direction. The third and fourth main ribs 14, 15 inclined in this manner allow the restitution performance to be demonstrated to the maximum in an upper portion of the toe. Specifically, an inclination θb of a central line 32 of the third and fourth main ribs 14, 15 with respect to the horizontal line 30 is preferably approximately 5° or more, more preferably approximately 10° or higher. Meanwhile, the upper limit of the inclination θb is preferably approximately 80° or less, more preferably approximately 70° or less. A central axis 33 of the reinforcement rib 16 preferably bisects an angle formed between the central axis 31 of the first and second main ribs 12, 13 and the central axis 32 of the third and fourth main ribs 14, 15 (i.e., the central axis 33 forms an angle θc with each of the central axes 31, 32).

The first and second main ribs 12, 13 may be smoothly curved into an S shape or Z shape instead of extending straight along the central axis 31. The third and fourth main ribs 14, 15 may also be smoothly curved into an S shape or Z shape instead of extending straight along the central axis 32. The main ribs smoothly curved in this manner allow increase in the area of both regions of the toe-crown region 19*a* and the heel-sole region 19*d*.

The thickness of the peripheral portion 19 of the face portion 11 is substantially uniform in each region of the toe-crown region 19*a*, the toe-sole region 19*b*, the heel-crown region 19*c*, and the heel-sole region 19*d*. The thicknesses in the toe-crown region 19*a*, the toe-sole region 19*b*, the heel-crown region 19*c*, and the heel-sole region 19*d* may be the same or different from one another. Preferably, to make uniform the COR at the peripheral portions of the toe-sole region 19*b* and the toe-sole region 19*c*, it is possible to form the toe-sole region 19*b* thinner than the toe-sole region 19*c*. This difference in thickness is preferably approximately 0.025 mm or larger, more preferably approximately 0.05 mm or more, and further preferably approximately 0.1 mm or more. Meanwhile, if the difference in thickness is too large, uniform restitution performance may not be obtained in some cases. Accordingly, the upper limit of the difference in thickness is preferably approximately 0.5 mm or less, more preferably approximately 0.4 mm or less.

The thickness of the toe-crown region 19*a* and the thickness of the toe-sole region 19*b* may be the same or different from each other. Nevertheless, to make more uniform the COR at portions on the crown side and on the sole side of the face portion, the toe-sole region 19*b* is preferably thinner than the toe-crown region 19*a*. This difference in thickness is preferably approximately 0.025 mm or more, more preferably approximately 0.05 mm or more, and further preferably approximately 0.1 mm or more. Meanwhile, if the difference in thickness is too large, uniform restitution performance may not be obtained in some cases. Accordingly, the upper limit of the difference in thickness is preferably approximately 0.5 mm or less, more preferably approximately 0.4 mm or less.

The thickness of the heel-crown region 19*c* and the thickness of the heel-sole region 19*d* may be the same or different from each other. When the heel-crown region 19*c* and the heel-sole region 19*d* differ in thickness, the difference in thickness is preferably approximately 0.05 mm or more but approximately 0.5 mm or less.

As shown in FIGS. 4 and 5, the intersecting portion 17 has, at its center portion, a center portion 18 that is the thickest portion thereof. Moreover, the intersecting portion 17 is formed to have a thickness which is reduced from the center portion 18 toward the peripheral portion 19 or the first to fourth main ribs 12 to 15. The center portion 18 includes a sweet spot of the face portion 11, that is, the center of gravity of the golf club head, which is projected on the surface of the face portion. Furthermore, the center portion 18 includes an intersection between the central axis of the first and second main ribs 12, 13 and the central axis of the third and fourth main ribs 14, 15. The sweet spot and the intersection of the main ribs may be at the same position or different positions. The intersection of the main ribs is disposed not on scorelines (not illustrated) formed in the front surface of the face portion 11 nor on extension lines of scorelines (not illustrated) partially formed on the toe side and the heel side of the face portion.

The center portion 18 is thicker than the thickest portion of the thickest main rib among the first to fourth main ribs 12 to 15. This difference in thickness is preferably approximately 0.1 mm or more but approximately 0.5 mm or less. In addition, the center portion 18 preferably has a flat circular shape as shown in FIG. 2. The radius of the flat circular center portion 18 is preferably approximately 5 mm or more but approximately 12 mm or less. Incidentally, the shape of the center portion 18 is not limited to such a circular shape, and may be elliptic or polygonal such as a tetragon (rectangle, rhombus, or the like), pentagon, or hexagon.

The thickest portions of the first to fourth main ribs 12 to 15 are made different in thickness from each other and from the peripheral portion 19 as described above. The thicknesses of the thickest portions of the first to fourth main ribs 12 to 15 are preferably approximately 3.0 mm or larger, more preferably approximately 3.2 mm or larger. Meanwhile, the upper limit of the thicknesses of the first to fourth main ribs 12 to 15 is preferably approximately 4.2 mm or less, more preferably approximately 4.0 mm or less. The thickness of the thickest portion of the reinforcement rib 16 is preferably approximately 3.0 mm or more, more preferably approximately 3.2 mm or more. Meanwhile, the upper limit of the thickness of the reinforcement rib 16 is preferably approximately 4.2 mm or less, more preferably approximately 4.0 mm or less.

The thickness of the peripheral portion 19 may differ among the toe-crown region 19*a*, the toe-sole region 19*b*, the heel-crown region 19*c*, and the heel-sole region 19*d* as described above. The thickness of the peripheral portion 19 is preferably approximately 1.0 mm or more, more preferably approximately 1.5 mm or more. Meanwhile, the upper limit of the thickness of the peripheral portion 19 is preferably approximately 3.0 mm or less, more preferably approximately 2.5 mm or less. The thickness of the center portion 18 differs from the thicknesses of the main ribs 12 to 15 as described above, and is preferably approximately 2.5 mm or more, more preferably approximately 2.7 mm or more. Meanwhile, the upper limit of the thickness of the center portion 18 is preferably approximately 4.0 mm or less, more preferably approximately 3.8 mm or less.

The face member 10 can be formed by any one of forging and casting. As the material of the face member 10, titanium, titanium alloy, stainless steel, or the like can be used. The volume of the golf club head 1 is preferably approximately 100 cc or larger, more preferably approximately 150 cc or larger. Meanwhile, the volume of the golf club head 1 is preferably approximately 500 cc or less, more preferably approximately 460 cc or less. The weight of the golf club head 1 is preferably approximately 170 g or more, more preferably approximately 175 g or more. Meanwhile, the weight of the golf club head 1 is preferably approximately 250 g or less, more preferably approximately 245 g or less.

Figure 7:
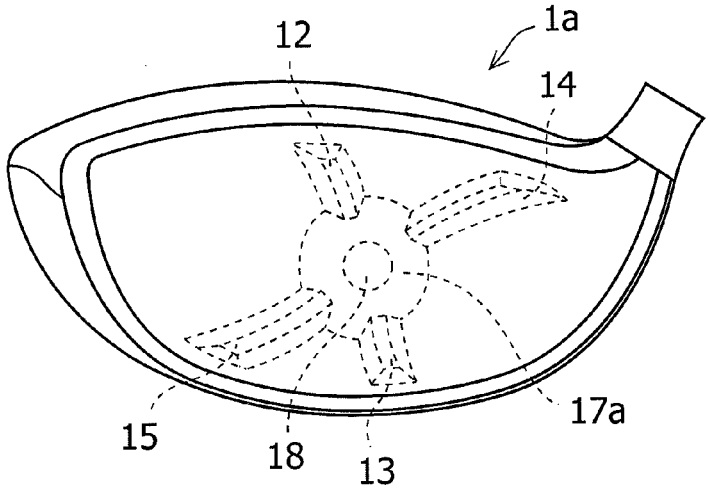
FIG. 7 is a front view showing a golf club head according to another embodiment of the present invention.

Note that, in the above-described embodiment, the reinforcement ribs 16 are provided as shown in FIGS. 1 to 6; however, as shown in FIG. 7, such reinforcement ribs do not necessarily have to be provided in the present invention. In addition, in the above-described embodiment, the face member 10 includes the entire face portion 11; however, the face member 10 may include a part of the face portion 11 (including a sweet area of the face portion 11). In this case, the width of the face member 10 is preferably approximately 55% or more, more preferably approximately 60% or more, of the width of the face portion 11. Meanwhile, the width of the face member 10 is preferably approximately 90% or less, more preferably approximately 85% or less of the width of the face portion 11. The height of the face member 10 is preferably approximately 50% or more, more preferably approximately 55% or more, of the height of the face portion 11. Moreover, the height of the face member 10 is preferably approximately 90% or less, more preferably approximately 85% or less, of the height of the face portion 11. The outer edges on the toe side and the heel side of the face member 10 are preferably substantially parallel to the central axis 31 of the first and second main ribs 12, 13. The main body member 20 preferably includes a toe-side portion and a heel-side portion of the face portion 11.

EXAMPLES

Golf club heads according to the present invention were prepared, and the coefficients of restitution (CORs) at face portions were evaluated. In the present examples, instead of actually measuring the COR values, the characteristic times (CTs) were measured. The CT value is a quantitative value and can be used to measure easily with high accuracy the spring effect of a face, which is adopted by the United States Golf Association (USGA) and Royal and Ancient Golf Club of St Andrews (R&A). The CT value can be measured with a portable pendulum machine (portable pendulum tester) approved by R&A Rules Limited. Generally, a face that flexes well causes a small loss in energy, and accordingly allows a high initial speed of the ball. For this reason, the CT value expresses such flexure with a contact time between a ball and a face. Now, by the rule, the uppermost limit is set at 257 (specified 239 with a tolerance of 18) μsec.

Figure 8:
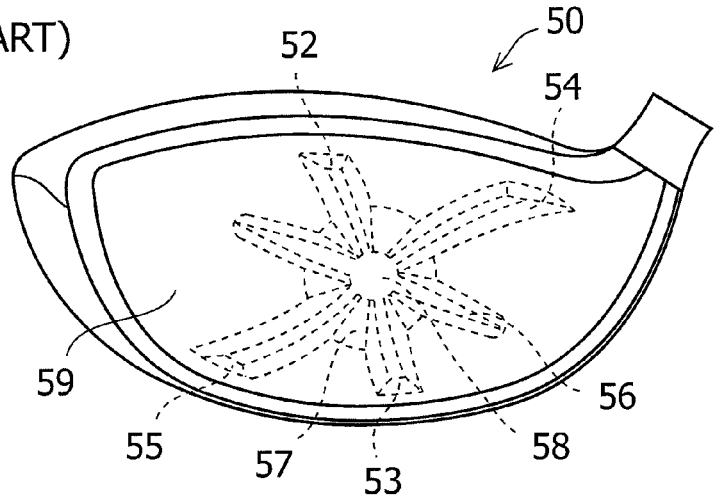
FIG.8 (RELATED ART)
FIG. 8 is a front view showing a golf club head of Comparative Example.

The golf club head of Example 1 was provided with the first to fourth main ribs and the reinforcement ribs as shown in FIG. 2. Among these, the main ribs located on the sole side were formed to have thickest portions which were thinner by 0.3 mm than those of the main ribs located on the crown side. The golf club head of Example 2 was the same as that of Example 1 except that the thicknesses of two regions in the peripheral portion were different. Example 3 was the same as Example 2 except that no reinforcement rib was provided as shown in FIG. 7. Meanwhile, a golf club head of Comparative Example was formed in such a way that a center portion 58, main ribs 52 to 55 and reinforcement ribs 56 all had the same thickness as shown in FIG. 8. In addition, a peripheral portion 59 had four regions of the same thickness. Table 1 shows the thicknesses of the center portion, the four main ribs, the peripheral portion divided into four regions by the main ribs, and the reinforcement ribs in each of Examples 1 to 3 and Comparative Example.

TABLE 1

| | | Example 1 | Example 2 | Example 3 | Comparative Example |
|---|---|---|---|---|---|
| Thickness of center portion [mm] | | 3.6 | 3.6 | 3.6 | 3.6 |
| Thickness of main rib [mm] | first main rib | 3.4 | 3.4 | 3.4 | 3.6 |
| | second main rib | 3.1 | 3.1 | 3.1 | 3.6 |
| | third main rib | 3.4 | 3.4 | 3.4 | 3.6 |
| | fourth main rib | 3.1 | 3.1 | 3.1 | 3.6 |
| Thickness of peripheral portion [mm] | toe-crown region | 2.4 | 2.4 | 2.4 | 2.4 |
| | toe-sole region | 2.4 | 1.9 | 1.9 | 2.4 |
| | heel-crown region | 2.4 | 2.3 | 2.3 | 2.4 |
| | heel-sole region | 2.4 | 2.4 | 2.4 | 2.4 |

TABLE 1-continued

| | | Example 1 | Example 2 | Example 3 | Comparative Example |
|---|---|---|---|---|---|
| Thickness of reinforcement rib [mm] | reinforcement rib on toe side | 3.5 | 3.5 | — | 3.6 |
| | reinforcement rib on heel side | 3.4 | 3.4 | — | 3.6 |

Note that the common conditions for the face portion were as follows. The width of the face portion was 75 mm; the height thereof was 43 mm; the first to fourth main ribs were inclined, as in FIG. 2, in such a way that the lengths of the reinforcement ribs were inclined 27 mm toward the toe and 25 mm toward the heel; the widths of the first to fourth main ribs were each 9.5 mm; and the widths of the reinforcement ribs were each 7.1 mm. Moreover, the common conditions for the golf club head were as follows. The material of the face member was a titanium alloy (Ti-6Al-4V); the head volume was 460 cc; and the head weight was 190 g.

Figure 9:
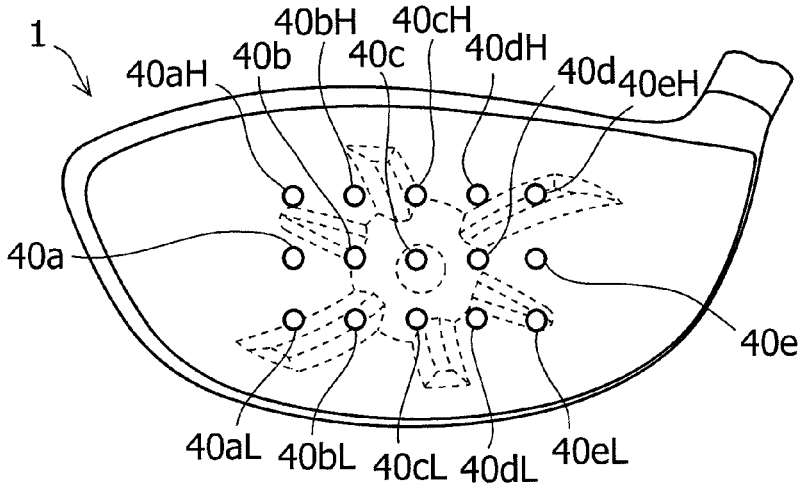
FIG. 9 is a front view illustrating positions of hitting points in simulation of Examples.

In each of Examples and Comparative Example, the CT values at ball-hitting points were measured. The CT values were measured with the ball-hitting points set at 15 hitting points which were different from one another in the vertical and horizontal directions as shown in FIG. 9. A central hitting point 40*c* was assumed to be a hitting point at the sweet spot and was located in the intersecting portion of the face member. The other 14 hitting points were assumed to be hitting points off the sweet spot. The hitting points 40*b*, 40*d* were positioned away by 10 mm from the central hitting point 40*c* toward the toe and toward the heel, respectively. The hitting points 40*a*, 40*e* were positioned away by 10 mm from the hitting points 40*b*, 40*d* toward the toe and toward the heel, respectively. Furthermore, the hitting points 40*a*H to 40*e*H and 40*a*L to 40*e*L were positioned away by 10 mm from these five hitting points 40*a* to 40*e* toward the crown and toward the sole, respectively.

Under these conditions, the CT values were measured at the hitting points in Examples 1 to 3 and Comparative Example. Tables 2 to 5 show the results. Note that, in Tables 2 to 5, the position of the central hitting point 40*c* was set at 0 mm. The distance toward the crown or heel was expressed as a positive value, while the distance toward the sole or toe was expressed as a negative value.

TABLE 2

| Example | CT value [μsec] | | | | |
|---|---|---|---|---|---|
| 1 | −20 mm | −10 mm | 0 mm | 10 mm | 20 mm |
| 10 mm | 226 | 233 | 226 | 231 | 231 |
| 0 mm | 235 | 239 | 238 | 249 | 228 |
| −10 mm | 198 | 224 | 224 | 224 | 196 |

TABLE 3

| Example | CT value [μsec] | | | | |
|---|---|---|---|---|---|
| 2 | −20 mm | −10 mm | 0 mm | 10 mm | 20 mm |
| 10 mm | 229 | 239 | 233 | 235 | 236 |
| 0 mm | 236 | 246 | 238 | 239 | 236 |
| −10 mm | 210 | 228 | 231 | 233 | 198 |

TABLE 4

| Example | CT value [μsec] | | | | |
|---|---|---|---|---|---|
| 3 | −20 mm | −10 mm | 0 mm | 10 mm | 20 mm |
| 10 mm | 250 | 239 | 233 | 235 | 231 |
| 0 mm | 243 | 246 | 238 | 245 | 245 |
| −10 mm | 210 | 228 | 233 | 233 | 219 |

TABLE 5

| Comparative | CT value [μsec] | | | | |
|---|---|---|---|---|---|
| Example | −20 mm | −10 mm | 0 mm | 10 mm | 20 mm |
| 10 mm | 223 | 226 | 225 | 228 | 229 |
| 0 mm | 223 | 237 | 238 | 237 | 224 |
| −10 mm | 196 | 216 | 218 | 211 | 181 |

As shown in Table 5, in the golf club head of Comparative Example in which the center portion, the main ribs, and the reinforcement ribs were all formed to have the same thickness, the CT values at the four hitting points 40*b*H, 40*b*L, 40*d*H, 40*d*L which were away from the central hitting point 40*c* in the crown-heel direction and in the toe-heel direction by ±10 mm were smaller than the CT values at the central hitting point 40*c* by 10 to 27 μsec. Meanwhile, in the golf club head of Example 1 in which the thicknesses of the first and third main ribs on the crown side were smaller than the thickness of the center portion by 0.2 mm and the thicknesses of the second and fourth main ribs on the sole side were smaller than the thicknesses of the first and third main rib on the crown side by 0.3 mm, the CT values at the four hitting points 40*b*H, 40*b*L, 40*d*H, 40*d*L were smaller than the CT value at the central hitting point 40*c* only by 5 to 14 μsec, indicating that the CT values of the face portion were more uniform than those in Comparative Example.

In the golf club head of Example 2 in which the thickness of the peripheral portion in the toe-sole region was smaller than the thickness thereof in the heel-crown region by 0.5 mm, the difference in CT value between the four hitting points 40*b*H, 40*b*L, 40*d*H, 40*d*L and the central hitting point 40*c* was 1 to 10 μsec, indicating that the CT values of the face portion were further uniform. In the golf club head of Example 3 in which no reinforcement rib was provided, the difference in CT value between the four hitting points 40*b*H, 40*b*L, 40*d*H, 40*d*L and the central hitting point 40*c* was 1 to 10 μsec, indicating that the CT values of the face portion was uniform as those in Example 2.

What is claimed is:

1. A golf club head having a hollow structure, comprising:

a face portion having a ball hitting surface; and at least four main ribs disposed on an inner surface of the face portion, wherein among the four main ribs, a first main rib extends from a center portion of the face portion toward a crown, a second main rib extends from the center portion toward a sole, and the other two main ribs also extend from the center portion toward the outside of the face portion, and the face portion is formed to have such a thickness of the center portion that is thicker than a thickness of the first main rib, which is thicker than a thickness of the second main rib, and the first main rib is convexly curved toward a heel side of the head and the second main rib is convexly curved toward a toe side of the head.

2. The golf club head according to claim 1, wherein among the four main ribs, a third main rib extends from the center portion toward a hosel, and a fourth main rib extends from the center portion toward a portion, closer to a toe, of the sole, and the face portion is formed to have such the thickness of the center portion is thicker than a thickness of the third main rib, which is thicker than a thickness of the fourth main rib.

3. The golf club head according to claim 2, wherein the third main rib is convexly curved toward the sole side and the fourth main rib is convexly curved toward the crown.

4. The golf club head according to claim 1, wherein the face portion is divided by the first to fourth main ribs into four regions: a region on a toe and crown side of the face portion; a region on a toe and sole side thereof; a region on a heel and crown side thereof; and a region on a heel and sole side thereof, and the face portion in the region on the toe and sole side is formed to have a thickness less than a thickness in the region on the heel and crown side.

5. The golf club head according to claim 4, wherein the third main rib is convexly curved toward the sole side and the fourth main rib is convexly curved toward the crown so that both areas of the toe-crown region and the heel-sole region increase.

6. The golf club head according to claim 1, wherein the center portion where the first to fourth main ribs intersect includes a center of gravity of the golf club head, which is projected on the surface of the face portion.

7. The golf club head according to claim 1 further comprising a reinforcement rib disposed on the inner surface of the face portion and extending toward the outside of the face portion from the center portion where the first to fourth main ribs intersect, wherein the reinforcement rib has a thickness gradually reduced from the intersecting portion in the outward direction, and is formed to extend to a position between the center portion and an end portion of the face portion.

8. The golf club head according to claim 7, wherein each of the four main ribs has a substantially constant thickness along the direction from the center portion to the outside of the face portion.

9. The golf club head according to claim 1, wherein thickness of the first main rib is 4.2 mm or less.

10. The golf club head according to claim 1, wherein a difference in the thickness of the first main rib and the thickness of the second main rib is 0.7 mm or less.

11. The golf club head according to claim 1, wherein the first main rib and the second main rib have a substantially constant width.

12. The golf club head according to claim 11, wherein the constant width is 2-12 mm.

13. The golf club head according to claim 1, wherein a difference in the thickness of the first main rib and the second main rib is 0.2 mm or more.

14. A golf club head having a hollow structure, comprising:

a face portion having a ball hitting surface;

at least four main ribs disposed on an inner surface of the face portion, each of the at least four main ribs having a substantially constant width; and a reinforcement rib disposed on the inner surface of the face portion wherein among the four main ribs, a first main rib extends from a center portion of the face portion toward a crown, a second main rib extends from the center portion toward a sole, a third main rib extends from the center portion toward a hosel, and a fourth main rib extends from the center portion toward a portion, closer to a toe, of the sole, and wherein the reinforcement rib extends toward the outside of the face portion from the center portion, the reinforcement rib having a thickness gradually reduced from the center portion in the outward direction and having a width gradually reduced from the center portion in the outward direction.

15. The golf club head according to claim 14, wherein each of the at least four ribs is curved.

16. The golf club head according to claim 15, wherein the first and second ribs are curved into a S or Z shape, and the third and fourth ribs are curved into a S or Z shape.

17. The golf club head according to claim 14, wherein a thickness of the center portion is thicker than a thickness of the first main rib, which is thicker than a thickness of the second main rib.

18. The golf club head according to claim 14, wherein a thickness of the center portion is thicker than a thickness of the third main rib, which is thicker than a thickness of the fourth main rib.

19. The golf club head according to claim 14, wherein the face portion is divided by the first to fourth main ribs into four regions: a region on a toe and crown side of the face portion; a region on a toe and sole side thereof; a region on a heel and crown side thereof; and a region on a heel and sole side thereof, and the face portion in the region on the toe and sole side is formed to have a thickness less than a thickness in the region on the heel and crown side.

20. The golf club head according to claim 14, wherein the center portion where the first to fourth main ribs intersect includes a center of gravity of the golf club head, which is projected on the surface of the face portion.

* * * * *